US008746017B2

(12) United States Patent
Huerth et al.

(10) Patent No.: US 8,746,017 B2
(45) Date of Patent: Jun. 10, 2014

(54) FRONT LOADING WASHER FOREIGN OBJECT GUARD

(75) Inventors: Andrew Huerth, Green Lake, WI (US); Khader Meshinesh, Oshkosh, WI (US)

(73) Assignee: Alliance Laundry Systems, LLC, Ripon, WI (US)

( * ) Notice: Subject to any disclaimer, the term of this patent is extended or adjusted under 35 U.S.C. 154(b) by 986 days.

(21) Appl. No.: 12/845,458

(22) Filed: Jul. 28, 2010

(65) Prior Publication Data

US 2012/0024018 A1 Feb. 2, 2012

(51) Int. Cl.
*D06F 23/00* (2006.01)

(52) U.S. Cl.
USPC ..... 68/140; 68/3 R

(58) Field of Classification Search
USPC ..... 68/3 R, 140
See application file for complete search history.

(56) References Cited

U.S. PATENT DOCUMENTS 2,613,837 A * 10/1952 Morton ..... 206/320
3,276,229 A * 10/1966 Deiss ..... 68/139
5,979,195 A * 11/1999 Bestell et al. ..... 68/23.2
6,205,603 B1 3/2001 Vande Haar
6,241,782 B1 * 6/2001 Vande Haar ..... 8/159
7,568,366 B2 * 8/2009 Chang et al. ..... 68/24

FOREIGN PATENT DOCUMENTS

DE 10360564 A1 7/2005
GB 2114606 A 8/1983

OTHER PUBLICATIONS

International Search Report, dated Jan. 25, 2012, in Corresponding PCT Application No. PCT/US2011/045509.

* cited by examiner

*Primary Examiner* — Michael Barr
*Assistant Examiner* — Benjamin L Osterhout
(74) *Attorney, Agent, or Firm* — Leydig, Voit & Mayer, Ltd.

(57) ABSTRACT

A front opening horizontal axis washing machine having an outer wash tub and a rotary inner tub basket for receiving items to be laundered. The inner and outer tub have an annular gap about respective frontal portions thereof, and an annular guard is fixed to the outer tub for reducing the size of the gap. The guard has an inner lip portion that extends radially inwardly and rearwardly with respect to the front opening of the basket for defining a relatively small axial gap with a front side of the inner rotating basket for more effectively preventing migration of foreign objects between the inner and outer tubs. The inner lip of the guard has a radial clearance with the frontal portion of the inner tub that is greater than the axial gap, but recessed from sight to a user of the machine.

18 Claims, 3 Drawing Sheets

FRONT LOADING WASHER FOREIGN OBJECT GUARD

FIELD OF THE INVENTION

The present invention relates generally to horizontal axis washing machines, and more particularly to an improved guard for preventing foreign objects from entering the gap between inner and outer tubs of such horizontal axis washing machine.

BACKGROUND OF THE INVENTION

Horizontal axis washing machines typically include a cabinet or housing within which is supported an outer wash tub into which liquid and cleaning fluids are introduced during a wash cycle. An inner tub or basket for retaining items to be laundered is rotatably mounted within the outer tub with front opening portions of the inner and outer tubs being arranged in concentric spaced relation to each other.

Due to the gap between the frontal portions of the inner and outer tubs of such horizontal clothes washing machines, foreign objects, including bobby pins, coins, large pieces of lint, and the like, can fall or migrate between the inner basket and the outer tub and make their way to the drain pump of the washing machine, clogging it and making it inoperable. This can be costly to the machine owner, requiring frequent cleaning and pump replacement. In addition, manufacturer warranty costs for replacement pumps is very high.

One approach for preventing objects from entering the gap is to mount a seal on the outer tub that covers the gap and rides in sliding contact with the relatively rotatable inner tub. Such contact type sealing arrangements have the propensity to wear, potentially losing their effectiveness and creating rough or jagged edges that can damage clothes within the rapidly rotating basket when operated at speeds up to 1000 rpm, as well create irritating noises. Such sealing arrangements also are relatively costly.

Another approach for preventing the entry of foreign objects into the gap between the inner and outer tubs of horizontal axis washing machines is to mount an annular guard on the front of the outer tub partially closing the gap. Such guards have an inner annular opening smaller than the diameter of the front opening of the outer tub so as to reduce the size of the gap between the wash tubs. While it is desirable that the annular guard provide as small as annular gap as possible about the inner rotating basket, a problem with such arrangements is that at high rotational speeds of the basket vibrations can occur, particularly with out of balance laundry loads, that cause the basket to engage and damage the guard, and in turn clothes within the rotating drum. Moreover, while such an annular guard reduces the size of the gap, the gap nevertheless is noticeable by a user during loading and unloading of laundry items and detracts from the appearance of the washing machine.

OBJECTS AND SUMMARY OF THE INVENTION

It is an object of the present invention to provide a horizontal axis washing machine having an outer tub with an annular guard that more effectively prevents the entry of foreign objects into the gap between inner and outer tubs of the washing machine.

Another object is to provide a washing machine with an annular guard as characterized above which defines a larger radial gap or clearance between the guard and wash tub so as to be less susceptible to damage by wash tub vibrations from out-of-balance loads or the like.

Another object is to provide a washing machine with an annular guard of the foregoing type which has a more aesthetic appearance to the user. A related object is to provide a washing machine with such annular guard that defines a gap with the rotary basket that is less noticeable by the user of the machine.

Still a further object is to provide a rotary axis washing machine having an annular guard that is relatively simple in construction and which lends itself to economical manufacture and long term reliable usage.

Other objects and advantages of the invention will become apparent upon reading the following detailed description and upon reference to the drawings, in which:

Figure 1:
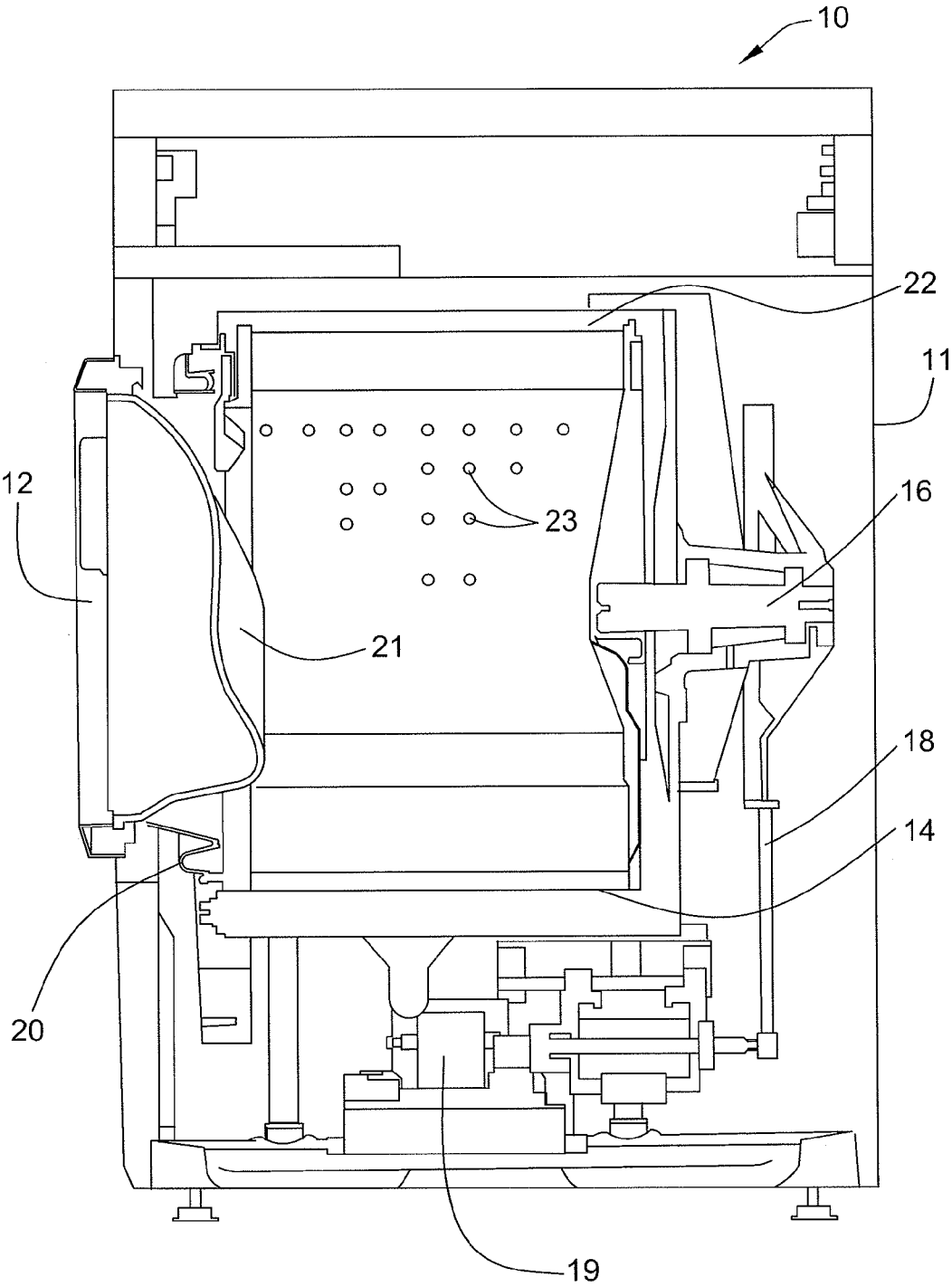
FIG. 1 is a vertical section of an illustrative washing machine having an annular guard in accordance with the invention for reducing the gap between the rotary basket and the outer wash tub.
Figure 2:
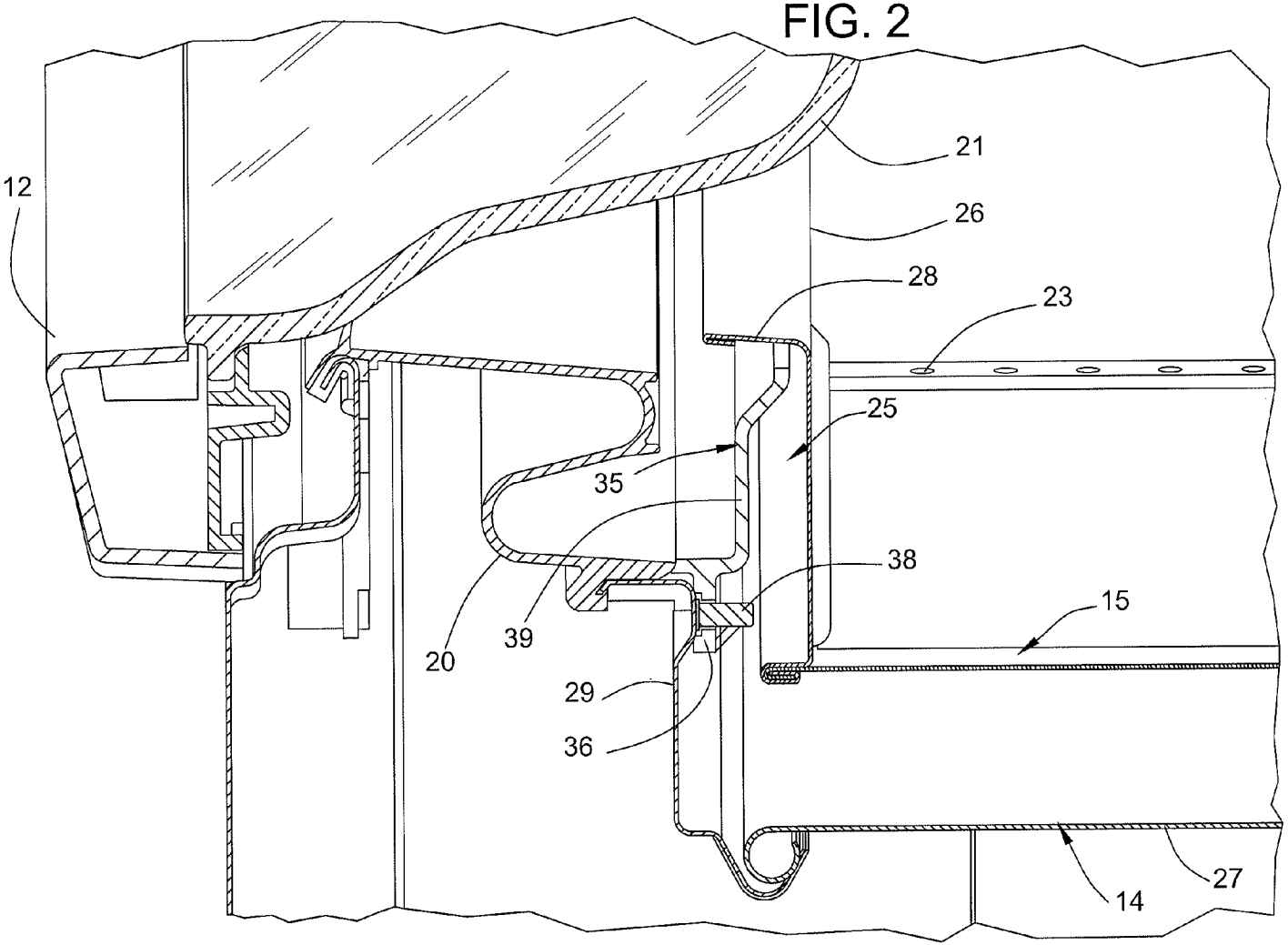
FIG. 2 is an enlarged vertical section of frontal portions of the illustrated washing machine and annular guard.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENTS

Referring now more particularly to the drawings, there is shown an illustrative horizontal axis washing machine 10 in accordance with the invention. The illustrative washing machine 10 includes a cabinet or frame 11 with a front opening access door 12, a front opening outer tub 14 mounted within the frame 11, and a front opening inner tub or basket 15 for receiving launderable items rotatably supported within the outer tub 14. For rotatably driving the inner basket 15, the inner basket 15 has a rearwardly extending drive shaft 16, driven via a pulley 18 from a motor 19 located below the outer tub 14. It will be understood by one skilled in the art that the basic construction and operation of such horizontal axis washing machine is well known in the art.

For providing a seal between the door 12 and outer tub 14 when in a closed position, an annular flexible boot or door seal 20, preferably made of molded rubber, is supported in forwardly extended relation to the outer tub 14 in surrounding relation to the front opening of the outer tub 14. The door 12 in this case has a central rearwardly shaped glass dome 21 which is moved into sealing engagement with the flexible boot or door seal 20 when in the closed position.

The inner basket 15 in this case comprises a cylindrical side wall 22 formed with perforations 23 which permit entry of wash water from the outer tub 14 into and through the inner basket 15, and a frontal portion 25 comprising a front panel 26 extending radially inwardly from the side wall 22 and a cylindrical lip 28 extending forwardly of the front panel 26 for defining a front opening of the inner wash basket 15. The outer tub 14 also has a generally cylindrical side wall 27 and a front panel 29 that defines the front opening of the outer tub 15. As in known in the art, the inner tub 15 is spaced from the outer tub 14 for free rotation therein. The special relationship also exists at the frontal portions of the outer and inner tubs 14,15 such that an annular gap is defined between front openings of the outer tub 14 and front opening of the inner rotary basket 15.

For reducing the front opening gap between the inner and outer tubs 14,15, an annular guard 35 is fixedly mounted on the front panel 29 of the outer tub 14. The annular guard 35 in this case includes an outer peripheral flange portion 36 secured to a rear side of the inner tub front panel 29, such as by a bolt 38, and radial wall portion 39 extending radially inwardly in slightly recessed relation from the front of the annular lip 28 of the inner basket 15. It will be understood that the annular guard 35 may not extend completely about the end portion of the inner basket, but only encompassed the area, such as the lower circumferential area, through which items most likely would migrate between the inner and outer tubs, such as between about the 3:00 and 9:00 positions. In the preferred embodiment, the annular guard extends about an underside of the inner basket frontal portion a circumferential distance of about 270°.

Figure 3:
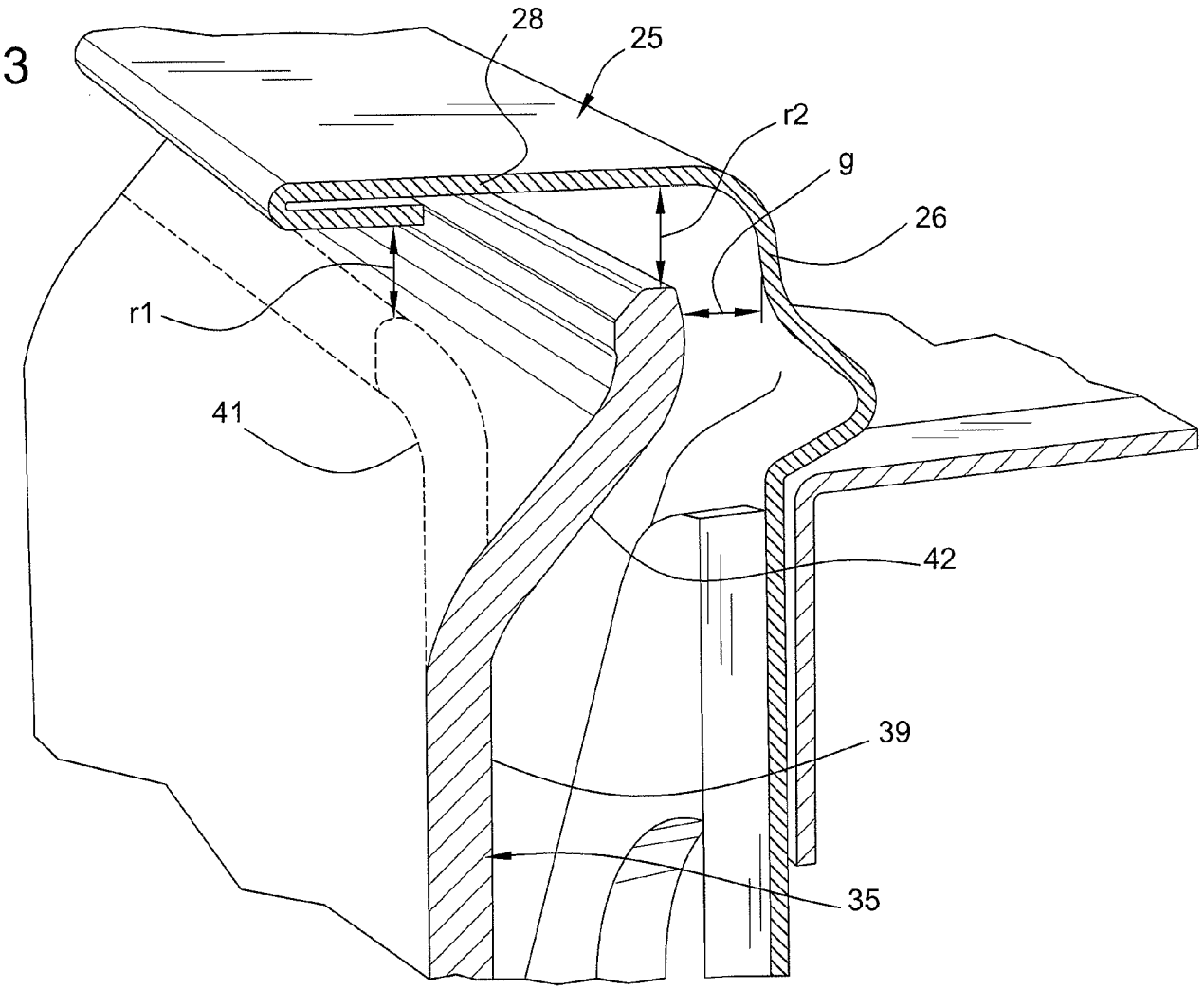
FIG. 3 is an enlarged perspective, in section, of the frontal portions and of the illustrated washing machine and annular guard.

Conventional guards included a forwardly curved inner lip portion 41, as depicted in phantom in FIG. 3, which defined a relatively small radial gap "r1" about the annular lip 28 of the inner basket 15. As is apparent from FIG. 3, the gap "r1", which is adjacent the front end of the annular lip 28 of the basket still was susceptible to small foreign objects migrating from the inner basket 15 into the gap "r1", as was apparent to a user of the washing machine when the front door 12 is open. Moreover, due to the relatively small radial depth of the gap "r1", vibrations of the rotating basket, particularly during out of balance loads within the basket, could cause damaging engagement between the rotating basket 15 and the lip 41 of the guard.

In accordance with an important feature of the invention, the guard has a rearwardly recessed inner tip portion which defines a gap with the inner wash tub that is less susceptible for receiving foreign objects from the inner tub and that is not noticeable by a user of the machine when the door is open. To this end, the illustrated guard 35 has an inner annular lip portion 42 which extends in inward and rearward relation to the front opening of the inner basket 15 for defining a relatively small axial gap "g" with the front side of the inner basket panel 26 that effectively prevents the migration of foreign objects between the inner basket 15 and the outer tub 14. By reason of such relatively small axial gap "g", the inner lip portion 42 of the guard 35 may be spaced with a greater radial clearance gap "r2" from the annular lip 28 of the inner basket 15 which is less susceptible for engagement of the guard 35 with the inner basket 15 during out of balance induced radial vibrations of the inner basket 15 during high speed operation. Preferably, the radial gap "r2" is greater than both the axial gap "g" and the radial gap "r1" of conventional guards. Moreover, since the inner lip 42 of the guard 35 is disposed in substantial recessed relation to the front of the annular lip 28 of the inner basket 15, it is not easily noticeable by a user of the washing machine and enhances the aesthetic appearance of the machine when the front door is open. Preferably, the inner lip portion 42 of the guard 35 is recessed from the front end of the inner basket lip 28 a distance "d" at least twice the axial gap "g", and most preferably, at least three times the axial gap "g". In an operative embodiment, the axial gap "g" may be 0.142 inches a radial gap "r2" may be 0.165 inches.

From the foregoing, it can be seen that an annular guard is provided for the horizontal axis washing machine that more effectively prevents entry of foreign objects into the gap between the inner and outer tubs of the washing machine. The annular guard further defines a relatively larger radial gap for clearance between the guard and the inner tub so as to be less susceptible to damage by wash tub radial vibrations from out-of-balance loads or the like. With the gap being in recessed relation to the frontal portion of the inner and outer wash tubs, the gap also is less noticeable by a user of the machine. Yet, the annular guard is relatively simple in construction and lends itself to economical manufacture and long term reliable usage. While in the illustrated embodiment the annular guard is a separate annular member fixed to the front portion of the outer tub, alternatively the guard may be an integral part of the outer tub.

The invention claimed is:

1. A washing machine comprising:

a cabinet, an outer tub mounted within said cabinet, said outer tub having an open frontal portion an inner basket mounted for rotation about a horizontal axis within said outer tub, a drive for rotating said inner basket during a wash cycle, said inner basket having a cylindrical side wall and an open frontal portion for receiving items to be laundered, said open frontal portion being spaced from the open frontal portion of the outer tub, said frontal portion of said inner basket including a front panel extending inwardly from the cylindrical side wall of the inner basket and an annular lip extending forwardly of said front panel for defining a front opening of the basket, said frontal portion of the outer tub having an annular guard extending radially inwardly in spaced relation about the annular lip of said frontal portion of said inner basket, said guard having an outer mounting portion fixed to said outer tub with a radial wall portion of said guard at a location rearwardly of a forward end of the annular lip of said frontal portion, said guard having an inner lip portion extending radially inwardly and axially rearwardly with respect to said radial wall portion of the guard and with respect to the frontal portion of said inner basket for defining a predetermined small axial gap measured parallel to the axis of said inner basket between the inner lip portion of the guard and a front side of the frontal portion of the inner basket for impeding the migration and movement of articles between the outer tub and inner basket.

2. The washing machine of claim 1 in which said annular guard is a separate annular member fixed to the frontal portion of the outer tub.

3. The washing machine of claim 1 in which said axial gap is located between the inner lip portion of said guard and the front panel of said basket.

4. The washing machine of claim 3 in which said inner lip portion of said guard defines a radial clearance gap with the annular lip of the basket frontal portion that is greater than said axial gap.

5. The washing machine of claim 3 in which the inner lip portion of said guard is disposed an axial distance rearwardly of a front end of the annular lip of the inner basket frontal portion greater than said axial gap.

6. The washing machine of claim 5 in which said inner lip portion of said guard is disposed a distance rearwardly of the front end of the annular lip of said inner basket a distance greater than each of said radial gap and axial gap.

7. The washing machine of claim 5 in which said inner lip portion of said guard is disposed a distance rearwardly from the front end of the annular lip of said inner basket a distance at least twice that of the axial gap.

8. The washing machine of claim 3 in which said guard extends in partial circumferential relation about the annular lip of said inner basket.

9. The washing machine of claim 1 in which said annular guard extends in 360° circumferential relation about the annular lip of the inner basket.

10. A washing machine comprising:

a cabinet, an outer tub mounted within said cabinet, said outer tub having an open frontal portion, an inner basket mounted for rotation about a horizontal axis within said outer tub, a drive for rotating said inner basket during a wash cycle, said inner basket having a cylindrical side wall and an open frontal portion for receiving items to be laundered, said open frontal portion being spaced from the open frontal portion of the outer tub, said frontal portion of said inner basket including a front panel extending inwardly from the cylindrical side wall of the inner basket and an annular lip extending forwardly of said front panel for defining a front opening of the basket, said frontal portion of the outer tub having an annular guard extending inwardly in spaced relation about the frontal portion of said inner basket, said guard having an outer mounting portion fixed to said outer tub and an inner lip portion extending inwardly for defining a radial clearance gap with the annular lip of the basket frontal portion and a rearward gap with respect to the front panel of said inner basket, said rearward gap being smaller than said radial gap.

11. The washing machine of claim 10 in which said annular guard is a separate annular member fixed to the frontal portion of the outer tub.

12. The washing machine of claim 10 in which the inner lip portion of said guard is disposed an axial distance rearwardly of a front end of the annular lip of the inner basket frontal portion greater than said rearward gap.

13. The washing machine of claim 11 in which said inner lip portion of said guard is disposed a distance rearwardly from the front end of the annular lip of said inner basket a distance at least twice that of said rearward gap.

14. A washing machine comprising:

a cabinet, an outer tub mounted within said cabinet, an inner basket mounted for rotation about a horizontal axis within said outer tub, a drive for rotating said inner basket during a wash cycle, said inner basket having a cylindrical side wall and an open frontal portion for receiving items to be laundered, said open frontal portion being spaced from an open frontal portion of the outer tub, said frontal portion of the outer tub having an annular guard extending radially inwardly in spaced relation about the frontal portion of said inner basket, said annular guard having an outer mounting portion fixed to said outer tub and an inner lip portion extending radially inwardly for defining a predetermined small axial gap measured parallel to the axis of said inner basket between the inner lip portion of the guard and a front side of the frontal portion of the inner basket for impeding the migration and movement of articles between the outer tub and inner basket, said inner lip portion of said guard being disposed an axial distance rearwardly of a front end of the annular lip of the inner basket frontal portion greater than the distance of said axial gap.

15. The washing machine of claim 14 in which the frontal portion of said inner basket includes a front panel extending radially inwardly from the cylindrical side wall of the inner basket and a cylindrical lip extending forwardly of said front panel for defining a front opening of the basket, and said axial gap being located between the inner lip portion of said guard and the front panel of said basket.

16. The washing machine of claim 15 in which said inner lip portion of said guard defines a radial clearance gap with the annular lip of the basket frontal portion that is greater than said axial gap.

17. The washing machine of claim 16 in which said inner lip portion of said guard is disposed a distance rearwardly of the front end of the annular lip of said inner basket a distance greater than each of said radial gap and axial gap.

18. The washing machine of claim 16 in which said inner lip portion of said guard is disposed a distance rearwardly from the front end of the annular lip of said inner basket a distance at least twice that of the axial gap.

* * * * *